US011313192B2

(12) United States Patent
Li et al.

(10) Patent No.: US 11,313,192 B2
(45) Date of Patent: Apr. 26, 2022

(54) METHOD FOR LOWERING OIL PIPE IN GAS WELL WITHOUT WELL-KILLING, SOLUBLE BRIDGE PLUG AND MATERIAL PREPARATION METHOD THEREOF

(71) Applicant: PetroChina Company Ltd., Beijing (CN)

(72) Inventors: Xianwen Li, Beijing (CN); Qiaorong Han, Beijing (CN); Yanming Zhang, Beijing (CN); Xu Ma, Beijing (CN); Zhanguo Ma, Beijing (CN); Yangming Hu, Beijing (CN); Changjing Zhou, Beijing (CN); Yuanxiang Xiao, Beijing (CN); Huaqiang Shi, Beijing (CN); Baochun Chen, Beijing (CN); Yonghong Gu, Beijing (CN); Xiaoyong Wen, Beijing (CN); Xuan'ang Lai, Beijing (CN); Yong Ding, Beijing (CN); Liang Ye, Beijing (CN); Qianyun Zhao, Beijing (CN); Xinxing Ma, Beijing (CN); Yajuan Wang, Beijing (CN); Man Bi, Beijing (CN); Hua Shi, Beijing (CN); Mingfang He, Beijing (CN); Xiaorui Liu, Beijing (CN); Wei Gao, Beijing (CN); Hongying Li, Beijing (CN); Yun Ling, Beijing (CN); Ruifen Hao, Beijing (CN); Lei Shen, Beijing (CN); Guohui Su, Beijing (CN); Shaowei Zhou, Beijing (CN); Shusheng Li, Beijing (CN); Zhe Li, Beijing (CN)

(73) Assignee: PetroChina Company Ltd.

( * ) Notice: Subject to any disclaimer, the term of this patent is extended or adjusted under 35 U.S.C. 154(b) by 162 days.

(21) Appl. No.: 16/607,068

(22) PCT Filed: Apr. 4, 2018

(86) PCT No.: PCT/CN2018/081837

§ 371 (c)(1),
(2) Date: Oct. 21, 2019

(87) PCT Pub. No.: WO2019/091043

PCT Pub. Date: May 16, 2019

(65) Prior Publication Data

US 2020/0040682 A1 Feb. 6, 2020

(30) Foreign Application Priority Data

Nov. 8, 2017 (CN) ..... 201711089828.9
Nov. 8, 2017 (CN) ..... 201711090120.5
(Continued)

(51) Int. Cl.
*E21B 29/02* (2006.01)
*C22C 1/03* (2006.01)
(Continued)

(52) U.S. Cl.
CPC ..... *E21B 29/02* (2013.01); *C22C 1/026* (2013.01); *C22C 1/03* (2013.01); *C22C 1/06* (2013.01);
(Continued)

(58) Field of Classification Search
CPC ..... E21B 29/02; E21B 33/12; E21B 33/1293; C22C 1/026; C22C 1/03; C22C 1/06; C22C 21/06
See application file for complete search history.

(56) References Cited

U.S. PATENT DOCUMENTS 7,117,948 B2 10/2006 Mazzella et al.
7,350,569 B2 * 4/2008 Collins ..... E21B 23/02 166/254.2
(Continued)

FOREIGN PATENT DOCUMENTS

CN 202170771 U 3/2012
CN 103452531 A 12/2013
(Continued)

OTHER PUBLICATIONS

Second Office Action dated Jan. 3, 2020 for counterpart Chinese patent application No. 201711384324.X, along with machine EN translation downloaded from EPO.
(Continued)

*Primary Examiner* — Aaron L Lembo
(74) *Attorney, Agent, or Firm* — Weaver Austin Villeneuve & Sampson LLP

(57) ABSTRACT

The present invention discloses a method for lowering an oil pipe in a gas well without well-killing, a soluble bridge plug
(Continued)

and a material preparation method thereof, wherein, the method comprises the steps of: lowering a bridge plug in a wellbore such that the bridge plug blocks the wellbore at a predetermined location in the wellbore; injecting water in the wellbore after the pressure in the wellbore has been relieved so as to replace gases in the wellbore; and lowering an oil pipe in the wellbore to the location of the bridge plug. The method for lowering an oil pipe in a gas well without well-killing, the soluble bridge plug and the material preparation method thereof provided in the present invention successfully solve the problem of high cost for lowering an oil pipe under pressure after a fracturing fluid has been injected into the casing.

10 Claims, 3 Drawing Sheets

(30) Foreign Application Priority Data

Dec. 20, 2017 (CN) ..... 201711384324.X
Dec. 20, 2017 (CN) ..... 201711384337.7

(51) Int. Cl.

| | |
|---|---|
| ***C22C 1/06*** | (2006.01) |
| ***C22C 21/06*** | (2006.01) |
| ***E21B 33/12*** | (2006.01) |
| ***C22C 1/02*** | (2006.01) |
| ***E21B 33/129*** | (2006.01) |

(52) U.S. Cl.
CPC ..... *C22C 21/06* (2013.01); *E21B 33/12* (2013.01); *E21B 33/1293* (2013.01)

(56) References Cited

U.S. PATENT DOCUMENTS

| | | | | |
|---|---|---|---|---|
| 8,211,247 | B2 * | 7/2012 | Marya | C22C 30/06 148/400 |
| 8,220,554 | B2 * | 7/2012 | Jordan | C22C 21/10 166/376 |
| 8,485,265 | B2 * | 7/2013 | Marya | E21B 33/1208 166/376 |
| 8,573,328 | B1 | 11/2013 | Ganzinotti et al. | |
| 8,668,019 | B2 * | 3/2014 | Casciaro | E21B 44/00 166/376 |
| 10,233,376 | B2 * | 3/2019 | Zhao | C09K 8/88 |
| 2007/0181224 | A1 * | 8/2007 | Marya | C22C 30/06 148/400 |
| 2008/0105438 | A1 | 5/2008 | Jordan et al. | |
| 2008/0149345 | A1 | 6/2008 | Marya et al. | |
| 2016/0265094 | A1 | 9/2016 | Xu et al. | |
| 2021/0047895 | A1 * | 2/2021 | Sherman | E21B 33/12 |

FOREIGN PATENT DOCUMENTS

| | | | |
|---|---|---|---|
| CN | 104074491 | A | 10/2014 |
| CN | 206280047 | U | 10/2014 |
| CN | 104480354 | A | 4/2015 |
| CN | 104612626 | A | 5/2015 |
| CN | 105385918 | A | 3/2016 |
| CN | 105545221 | A | 5/2016 |
| CN | 105971556 | A | 9/2016 |
| CN | 106481308 | A | 3/2017 |
| CN | 206091892 | U | 4/2017 |
| CN | 106801590 | A | 6/2017 |
| CN | 107013181 | A | 8/2017 |
| CN | 107151754 | A | 9/2017 |
| EP | 2199541 | A1 | 6/2020 |
| WO | WO2009085780 | A2 | 7/2009 |
| WO | WO2015009213 | A1 | 1/2015 |
| WO | WO2017/086955 | A1 | 5/2017 |

OTHER PUBLICATIONS

Second Office Action dated Aug. 5, 2019 for counterpart Chinese patent application No. 201711384337.7, along with machine EN translation downloaded from EPO.
The Third Office Action and search report dated Jul. 20, 2020 for counterpart Chinese patent application No. 201711384337.7, along with machine EN translation downloaded from EPO.
Ding-Yanhong et.al, Yejin Cailiaokexuejichu, pp. 384-386, Aug. 31, 2017.
China National Petroleum Corporation Labor Bureau, Caiqigong, pp. 18-19, 2001022.
The Third Office Action and search report dated Aug. 4, 2020 for counterpart Chinese patent application No. 201711384324.X, along with machine EN translation downloaded from EPO.
International search report issued for counterpart Chinese patent application No. PCT/CN2018/081837 dated Aug. 8, 2018.
First Office Action and search report dated Jul. 3, 2019 for counterpart Chinese patent application No. 201711384324.X with machine EN translation downloaded from EPO.
Sichuan publishing workers association college publishing work committee series from book metalworking practice,Jan. 31, 2012, Zhu Min, pp. 43-47.
First Office Action and search report dated Jan. 3, 2019 for counterpart Chinese patent application No. 201711384337.7 with machine EN translation downloaded from EPO.
Second Office Action dated Aug. 5, 2019 for counterpart Chinese patent application No. 201711384337.7 with machine EN translation downloaded from EPO.

* cited by examiner

METHOD FOR LOWERING OIL PIPE IN GAS WELL WITHOUT WELL-KILLING, SOLUBLE BRIDGE PLUG AND MATERIAL PREPARATION METHOD THEREOF

INCORPORATION BY REFERENCE

An Application Data Sheet is filed concurrently with this specification as part of the present application. Each application that the present application claims benefit of or priority to as identified in the concurrently filed Application Data Sheet is incorporated by reference herein in its entirety and for all purposes.

TECHNICAL FIELD

The present invention belongs to the technical field of oil and gas exploitation engineering, in particular relates to a method for lowering an oil pipe in a gas well without well-killing, a soluble bridge plug and a material preparation method thereof.

BACKGROUND

At present, in petroleum industry, downhole tools are mostly made of alloy steel with high strength and good workability. The treatment of some of these tools after use or in case of failure has become a major problem that seriously affects the operational efficiency and the development benefits of oil fields.

Studies have shown that this problem can be effectively solved if the tool can be dissolved in proper time as needed after use or in case of failure. Soluble metal (alloy) materials have the properties of high strength and solubility. At present, countries around the world have done researches and developments on soluble metal materials and applied many patents: US 2007/0181224 discloses a composition of soluble metal materials, which mainly comprises one or more active metals in a large proportion and a small amount of one or more alloying products, wherein the active metal elements mainly include aluminum (Al), gallium (Ga), indium (In), zinc (Zn) and bismuth (Bi), the soluble material made from which is capable of being completely dissolved; US 2008/0105438 discloses a soluble material with high strength and high controllability that can be used to manufacture oil field whipstocks and deflectors; US 2008/0149345 discloses a soluble material capable of being dissolved intelligently, the material activating the components after dissolution downhole and mainly consisting of an alloy of calcium, magnesium or aluminum, or a composite of these materials.

The materials used in the above patents generally include an expensive metal such as indium, and the bridge plug thus manufactured has the disadvantage of high production cost, and at the same time, due to the requirements in the existing field of use, the material strength index is low, which cannot meet the demands for oil field developments.

In addition, in a gas well after a fracturing liquid has been injected into the casing (wellbore), there are two conventional methods for lowering an oil pipe. The first method is, after a fracturing fluid has been injected into the casing, first performing well-killing with a kill fluid, lowering a bridge plug and testing pressure, and then lowering an oil pipe of a required specification in a pressure-free condition. This method achieves to carry out the operation without well-killing, but the kill fluid used for well-killing will greatly damage the reservoir. The second method is, as shown in FIG. 1, directly lowering an oil pipe of a required specification in an under-pressure condition after a fracturing fluid has been injected into the casing. However, the cost of this method is very high.

SUMMARY

In view of the deficiencies of the prior art, the purpose of the present invention is to provide a method of lowering an oil pipe in a gas well without well-killing, a soluble bridge plug and a material preparation method thereof, so as to solve at least one of the above technical problems.

The technical solutions of the present invention are as follows.

The present invention provides a method of lowering an oil pipe in a gas well without well-killing, comprising the steps of:

lowering a bridge plug in a wellbore such that the bridge plug blocks the wellbore at a predetermined location in the wellbore;

injecting water in the wellbore to replace gases therein after pressure in the wellbore has been relieved; and lowering an oil pipe in the wellbore to the location of the bridge plug.

As a preferred embodiment, the bridge plug is lowered to the predetermined location in the wellbore in an under-pressure condition by means of a cable, a setting mechanism connected to the cable is connected above the bridge plug, and the setting mechanism is controlled by the cable to push the bridge plug to block the wellbore.

As a preferred embodiment, when lowering the bridge plug, pressure is applied from outside the well into the wellbore to push the bridge plug to move until it reaches the predetermined location, and the setting mechanism is controlled by the cable to push the bridge plug to block the wellbore after the pressure application from outside the well into the wellbore has been stopped.

As a preferred embodiment, water is injected into the wellbore to replace gases therein after pressure in the wellbore has been relieved to be balanced with atmospheric pressure.

As a preferred embodiment, a depth position of the predetermined location is higher than a top end of a fracturing perforation section.

As a preferred embodiment, the bridge plug is a soluble bridge plug.

As a preferred embodiment, the method further comprises: dissolving the soluble bridge plug by injecting a bridge plug dissolving solution through the oil pipe after the oil pipe has been lowered to the location of the bridge plug.

As a preferred embodiment, the soluble bridge plug is made of an Mg—Al—Zn—Sn alloy material.

As a preferred embodiment, the bridge plug dissolving solution is formed by one or a mixture of several of an acidic salt buffer solution, a glutamic acid-hydrochloric acid buffer solution, an acetic acid-sodium acetate buffer solution and a citric acid-sodium citrate buffer solution.

As a preferred embodiment, the acidic salt buffer solution is a sodium bicarbonate solution, a potassium bicarbonate solution or a sodium bisulfate solution.

As a preferred embodiment, the addition amount of acidic salt is 0.05-0.4 mol/L.

As a preferred embodiment, the respective addition amount of glutamic acid-hydrochloric acid, acetic acid-sodium acetate and citric acid-sodium citrate is 0.1-0.3 mol/L.

The present invention also provides a soluble bridge plug used in the above method for lowering an oil pipe in a gas well without well-killing, comprising: a main body and a rubber cylinder sleeved over the main body, the material of the main body comprising 85-90% of an Mg—Al binary alloy, 6-9% of Zn and 4-8% of Sn.

As a preferred embodiment, the mass fraction of Mg in the main body is 5-7%.

As a preferred embodiment, the main body comprises a central pipe, a push ring, an upper slip, a lower slip and a guide shoe; the push ring, the upper slip and the lower slip are provided outside the central pipe, and the rubber cylinder is sleeved over the central pipe and located between the upper slip and the lower slip; the push ring is located above the upper slip; and the guide shoe is connected to a lower end of the central pipe.

The present invention also provides a method for preparing a material of a main body of a soluble bridge plug according to any of the above embodiments, the method comprising:

melting the Mg—Al binary alloy at a predetermined temperature to form an aluminum alloy solution; and adding Zn and Sn in the aluminum alloy solution and evenly stirring the solution.

As a preferred embodiment, Zn and Sn are added in the aluminum alloy solution after scum has been removed from the aluminum alloy solution.

As a preferred embodiment, a predetermined amount of a nitrate refining agent is added to perform descumming after Zn and Sn have been added and the solution has been evenly stirred.

As a preferred embodiment, the nitrate refining agent occupies 0.3-0.5% of the total mass of the Mg—Al binary alloy.

Advantageous Effects are as Follows

The method for lowering an oil pipe in a gas well without well-killing provided by the present invention can successfully solve the problem of high cost for lowering an oil pipe under pressure after a fracturing fluid has been injected into the casing. Meanwhile, the method can also solve the problem of damage caused by a kill fluid to the reservoir when well-killing is carried out with the kill fluid prior to lowering a production oil pipe of a required specification without pressure, after a fracturing fluid has been injected into the casing. Thus, the method achieves the purposes of saving costs and protecting the reservoir.

Referring to the following descriptions and figures, the specific embodiments of the present invention have been disclosed in detail, and the modes in which the principle of the present invention can be used have been clearly pointed out. It should be understood that the embodiments of the present invention will not be limited thereby in scope. The embodiments of the present invention include a lot of alternations, modifications and equivalents within the scope of the spirit and clauses of the appended claims.

Features that are described and/or illustrated for one embodiment may be used in the same way or in a similar way in one or more other embodiments, in combination with or instead of the features in the other embodiments.

It should be emphasized that the term "comprise/contain", when used in this text, is taken to specify the presence of features, integers, steps or components, but does not preclude the presence or addition of one or more other features, integers, steps or components.

BRIEF DESCRIPTION OF THE DRAWINGS

In order to explain more clearly the embodiments in the present invention or the technical solutions in the prior art, the following will briefly introduce the figures needed in the description of the embodiments or the prior art. Obviously, figures in the following description are only some embodiments of the present invention, and for a person skilled in the art, other figures may also be obtained based on these figures without paying any creative effort.

Figure 1:
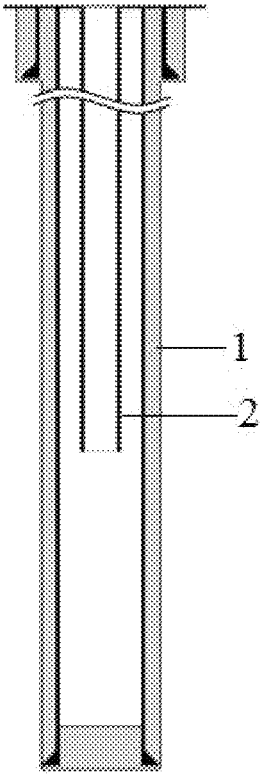
FIG. 1 is a schematic diagram of a gas well with an oil pipe conventionally lowered therein in the prior art.

In these figures: 1. wellbore (casing); 2. oil pipe; 3. soluble bridge plug.

DETAILED DESCRIPTION OF THE INVENTION

In order to enable persons in this technical field to better understand the technical solutions of the present invention, clear and comprehensive descriptions to the technical solutions in the embodiments of the present invention will be given below in combination with the figures in the embodiments of the present invention, and obviously, the embodiments described here are only a part of, rather than all of, the embodiments of the present invention. Based on the embodiments in the present invention, all other embodiments obtained by the ordinary skilled persons in this field without paying any creative effort should fall within the scope of protection of the present invention.

It should be clearly stated that when an element is referred to as being "provided on" another element, it can be directly on the other element, or an intervening element may also exist. When an element is referred to as being "connected to" another element, it can be directly connected to the other element, or an intervening element may also exist at the same time. The terms "vertical", "horizontal", "left" and "right" as well as other similar expressions used herein are for the purpose of explanation only and do not represent the unique embodiment.

Unless otherwise defined, all technical and scientific terms used herein have the same meaning as commonly understood by the skilled persons belonging to the technical field of the present invention. The terms used in the Description of the present invention are for the purpose of describing the specific embodiments only, and are not intended for limiting the present invention. The term "and/or" used in this text includes any and all combinations of one or more of the associated listed items.

The embodiments of the present invention provide a soluble bridge plug, comprising: a main body and a rubber cylinder sleeved over the main body, the material of the main body comprising 85-90% of an Mg—Al binary alloy, 6-9% of Zn, and 4-8% of Sn.

When the soluble bridge plug is to be dissolved after it has been lowered to a specified location in a wellbore, a bridge plug dissolving solution is injected to partially dissolve the main body of the rubber cylinder. At the same time, as the main body is dissolved, the rubber cylinder in a blocking state will naturally elongate to deblock the wellbore, and therefore the wellbore is no longer blocked.

To be specific, when the soluble bridge plug is used, first of all, the soluble bridge plug which matches with the inner diameter of the wellbore is lowered into the wellbore such that the soluble bridge plug sits at a predetermined location in the wellbore (casing) to block the wellbore, water is injected into the wellbore to replace gases therein after the pressure in the wellbore has been relieved, and thereafter an oil pipe is lowered to the location of the soluble bridge plug, via which oil pipe a bridge plug dissolving solution is injected to dissolve the soluble bridge plug.

In this embodiment, an Mg—Al binary alloy is used as a matrix alloy, on the basis of which Zn and Sn are further added. The mass percentage of the Mg—Al binary alloy is 80-90%, the mass percentage of Zn is 5-8%, and the mass percentage of Sn is 2-5%, wherein, the mass percentage of Mg is 5-7%. An Mg—Al—Zn—Sn alloy is thus formed, which endows the soluble bridge plug with a yield strength of over 300 MPa and enables it to resist a temperature of over 170° C. and a pressure of 70 Mpa. The soluble bridge plug made of this material can only react with a matched bridge plug dissolving solution (described below), and will not be dissolved in advance when contacting water or other fluids during operations.

It can thus be seen that, by setting the material of the main body as comprising 85-90% of an Mg—Al binary alloy, 6-9% of Zn and 4-8% of Sn, the soluble bridge plug in this embodiment can have better material strength to meet the strength requirement for blocking a gas well. Meanwhile, the material of the main body does not include any expensive metal material such as indium, hence the manufacturing cost is low.

In one embodiment, the material of the main body consists of 85-90% of an Mg—Al binary alloy, 6-9% of Zn and 4-8% of Sn. In this way, the material of the main body of the soluble bridge plug only consists of four elements, i.e. magnesium (Mg), aluminum (Al), zinc (Zn) and tin (Sn). The required constituent elements of the material are easy to obtain. Besides, since only a few elements are needed, the degree of addition in the preparation process is less, thus the difficulty of preparation is reduced.

In contrast, current soluble bridge plug materials often have a complex composition (generally comprising more than six elements), and rare earth elements are commonly used to improve the material properties so as to obtain the bridge plug materials of desired strength. However, problems are brought about as the materials are difficult to obtain, the manufacturing cost is high and the preparation process is complex. To solve these problems, the inventors, based on years of research and unceasing experimentations in this field, discovered that the material prepared from magnesium (Mg), aluminum (Al), zinc (Zn) and tin (Sn) rather than rare earth elements not only can satisfy the strength requirement of a bridge plug, but also has an advantage of being formed by simple and easily obtainable elements, which will facilitate the manufacture and application, and hence the material has a very great practical application value. At the same time, the main body of the soluble bridge plug made of this material can be dissolved very quickly under the effect of the bridge plug dissolving solution, thereby accelerating the deblocking. In this embodiment, in order to obtain the optimal material, the mass fraction of Mg in the main body is 5-7%.

In this embodiment, the main body can comprises a central pipe, a push ring, an upper slip, a lower slip and a guide shoe. The push ring, the upper slip and the lower slip are sleeved outside the central pipe, and the rubber cylinder is sleeved outside the central pipe and located between the upper slip and the lower slip. The push ring is located above the upper slip. The guide shoe is connected to a lower end of the central pipe.

To be specific, an upper end of the central pipe is a connection end for connecting a setting mechanism. The rubber cylinder is sleeved outside the central pipe for radially positioning the soluble bridge plug in a squeezed state. The main body can also be provided with cones located on upper and lower sides of the rubber cylinder. The cones are also sleeved outside the central pipe, and can move in an axial direction of the central pipe to apply opposite squeezing forces to the rubber cylinder so as to set the rubber cylinder by squeezing.

In this embodiment, the upper slip and the lower slip can axially position the bridge plug, and can drive the cones to squeeze the rubber cylinder before positioning the bridge plug. A cone is respectively provided between the upper slip and the rubber cylinder and between the lower slip and the rubber cylinder. Thus, by pushing the cones, the rubber cylinder is squeezed. The push ring is sleeved outside the central pipe and adjacent to the connection end. The push ring, after receiving a setting force applied by the setting mechanism, is capable of driving the upper slip and the lower slip to push the cones to move, until the upper slip and the lower slip are extended out to be anchored on the wellbore, and then the setting is finished.

A plurality of openings for accommodating a wear-resistant material is provided on the circumference of the upper and lower slips to increase the friction on the contact surfaces. The wear-resistant material may be, for example, a ceramic material. Since the friction coefficient of a ceramic material is large, it can effectively improve the surface friction of the slips, so that the soluble bridge plug can be well positioned in an axial direction.

In this embodiment, the rubber cylinder comprises a first rubber cylinder and a second rubber cylinder that contact each other, wherein the second rubber cylinder has a conical contact surface with the lower cone. The conical contact surface between the second rubber cylinder and the lower cone helps increasing the force receiving area of the second rubber cylinder, so that the lower cone can effectively stop movement of the rubber cylinder components towards the lower cone.

In this embodiment, after the main body has been dissolved, the materials of the upper slip and the lower slip (upper cone) of the main body and the rubber cylinder can be, for example, degradable biological materials. To be specific, the material of the rubber cylinder may comprise: 30-90 wt % of a polyglycolic acid polymer, 5-40 wt % of a flexible epoxy resin, 5-50 wt % of a butyronitrile rubber and 1-25 wt % of a rubber additive.

A magnetic locater can also be provided above the soluble bridge plug when in use. The magnetic locater can be connected to the cable by which the soluble bridge plug is lowered. The depth of the soluble bridge plug and the slope of the well are determined by means of the magnetic locater. Operators outside the well can measure the traveling curve of the magnetic locater by tracking the magnetic locater, and observe whether the measured positioning pup joints are normal according to the traveling curve of the magnetic locater.

In specific use, a delivery device such as a cable or a tubular column is used to deliver the soluble bridge plug to the predetermine location in the wellbore. A setting force, generated by cable-controlled gunpowder explosion or by hydraulic or mechanical setting tools, acts on the push ring, which, after receiving the setting force, drives the upper and lower slips. The upper and lower slips drive the upper and lower cones after receiving the driving force from the push ring. The upper and lower cones move towards the rubber cylinder after receiving the driving force from the upper and lower slips and thereby apply a squeezing force to the rubber cylinder. The rubber cylinder shrinks after receiving the squeezing force from the upper and lower cones. Thereafter, the diameter of the rubber cylinder increases such that the rubber cylinder closely abuts the inner wall of the wellbore and thereby achieves the effect of radial positioning.

Meanwhile, since the rubber cylinder cannot be further squeezed after being radially positioned, the upper and lower slips continue to be pushed by the push ring and are held apart by the cones, and thus are anchored on the wellbore, thereby realizing the axial positioning. In this way, the soluble bridge plug is positioned both radially and axially, thus it is ensured that the bridge plug provided in this embodiment is accurately positioned, so that normal operations are ensured to be effectively performed. In addition, since the main body (central pipe, rubber cylinder, upper cone, lower cone, upper slip, lower slip and push ring) of the soluble bridge plug is made of a soluble material, i.e. the soluble bridge plug can be dissolved by a bridge plug dissolving solution, the main body of the soluble bridge plug can be removed by dissolution, and thereupon the rubber cylinder deblocks the wellbore. In this way, the bridge plug decomposition operation enables the omission of the boring process in the prior art, and also, the problem of drillings produced in the boring process does not exist.

For better understanding of the present invention, descriptions of the soluble bridge plugs provided in several specific examples of the present invention are given below.

Example 1

On the basis of the above embodiment, this embodiment provides a controllable dissolution bridge plug made of an Mg—Al—Zn—Sn alloy prepared from the following raw materials in the following mass percentages: 85% of an Mg—Al binary alloy, 9% of Zn and 8% of Sn. The specific preparation process can be seen in Example 1.

Example 2

On the basis of the above embodiment, this example provides a controllable dissolution bridge plug made of an Mg—Al—Zn—Sn alloy prepared from the following raw materials in the following mass percentages: 87% of an Mg—Al binary alloy, 7% of Zn and 6% of Sn. The specific preparation process can be seen in Example 1.

Example 3

On the basis of the above embodiment, this example provides a controllable dissolution bridge plug made of an Mg—Al—Zn—Sn alloy prepared from the following raw materials in the following mass percentages: 90% of an Mg—Al binary alloy, 6% of Zn and 4% of Sn. The specific preparation process can be seen in Example 1.

Figure 2:
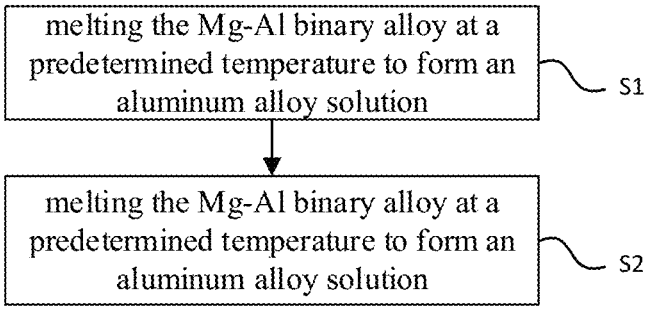
FIG. 2 is a flow chart of a method for preparing a material of a main body of a soluble bridge plug provided in the embodiments of the present invention.

As shown in FIG. 2, the embodiments of the present invention also provide a method for preparing a material of a main body of a soluble bridge plug according to any of the above examples, the method comprising:

S1: melting the Mg—Al binary alloy at a predetermined temperature to form an aluminum alloy solution; and S2: adding Zn and Sn in the aluminum alloy solution and evenly stirring the solution.

To be specific, a predetermined amount of the Mg—Al binary alloy is conventionally melted at 700-760° C. In order to prevent the obtained main body material from containing impurities which affect the material properties, Zn and Sn are added in the aluminum alloy solution after scum has been removed from the aluminum alloy solution. In order to further prevent the main body material from containing impurities which affect the material properties, a predetermined amount of a nitrate refining agent is added to perform descumming after Zn and Sn have been added and the solution has been evenly stirred. The nitrate refining agent is 0.3-0.5% of the total mass of the Mg—Al binary alloy.

In a specific example of the method for preparing a material of a main body of a soluble bridge plug, a specified amount of the Mg—Al binary alloy is conventionally melted at 700-760° C. to become an aluminum alloy solution. After the Mg—Al binary alloy has been completely melted, scum on the solution is removed. After that, specified amounts of Zn and Sn are sequentially added in the aluminum alloy solution, and the solution is stirred for 3-5 minutes and homogenized for 20-30 minutes. At last, the nitrate refining agent of 0.3-0.5% of the total mass of the Mg—Al binary alloy is added to perform descumming.

Figure 3:
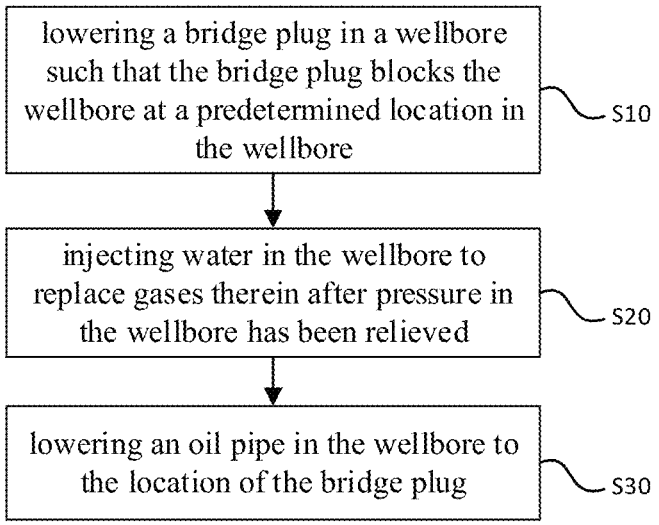
FIG. 3 is a flow chart of a method for lowering an oil pipe provided by an embodiment of the present invention.
Figure 4:
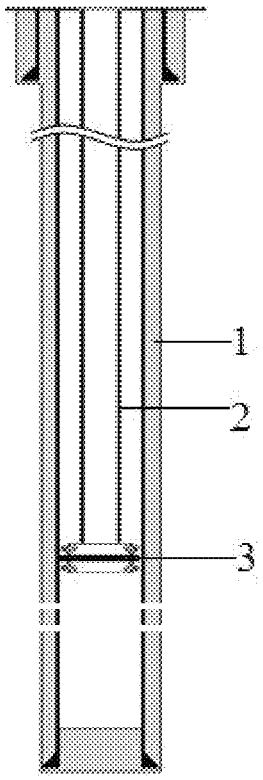
FIG. 4 is a schematic diagram of a gas well for which the method shown in FIG. 3 is employed.

In order to solve the problems of high cost, long period and damage to the reservoir caused by placing an oil pipe using conventional methods after fracturing, referring to FIGS. 3 and 4, the embodiments of the present invention further provide a method of lowering an oil pipe in a gas well without well-killing, which comprises the steps of:

S10: lowering a bridge plug 3 in a wellbore 1 such that the bridge plug 3 sits at a predetermined location in the wellbore 1 and blocks the wellbore 1;

S20: injecting water in the wellbore 1 to replace gases therein after pressure in the wellbore 1 has been relieved; and S30: lowering an oil pipe 2 in the wellbore 1 to the location of the bridge plug 3.

In the method of placing an oil pipe in a gas well without well-killing provided in this embodiment, first of all, the bridge plug 3 is lowered (by means of a cable) in an under-pressure condition to block the wellbore 1 (casing 1) in a fracturing gas layer section (also referred to as a fracturing perforation section), then a pressure-free condition is formed by wellbore pressure relief, and at last a production oil pipe 2 of a corresponding specification is lowered to the location of the bridge plug 3 in the pressure-free condition. This method successfully solves the problem of high cost for placing an oil pipe under pressure after a fracturing fluid has been injected into the casing, and also solves the problem of damage caused by a kill fluid to the reservoir when well-killing is carried out with the kill fluid prior to lowering the production oil pipe 2 of a required specification after a fracturing fluid has been injected into the casing, thereby achieving the purposes of saving costs and protecting the reservoir.

In this embodiment, step S10 is carried out after the fracturing has been finished. In step S10, after the bridge plug 3 is set to block the wellbore 1 at the predetermine location, the wellbore 1 is blocked to form an upper and a lower wellbore 1 section, wherein the pressure-free state can be formed in the upper wellbore 1 section by pressure relief as described in step S20.

However, in view that the remaining gases in the wellbore 1 may be combustible gases (natural gas), and the concentrations thereof have been reduced and may be within the explosion limits, if the oil pipe 2 is directly lowered into the wellbore 1, the friction produced between the oil pipe 2 and the wellbore 1 (casing) will easily cause explosion and other safety accidents. On this basis, as described in step S20, water is injected into the wellbore 1 to replace the gases (natural gas) therein, so that there is no need to worry about the friction between the oil pipe 2 and the wellbore 1 in the process of lowering the oil pipe 2, and thus the safety level is improved.

In step S10, the bridge plug 3 can be lowered to the predetermined location in the wellbore 1 by means of a cable under pressure, and a setting mechanism connected to the cable is connected above the bridge plug 3. The setting mechanism is controlled by the cable to push the bridge plug 3 to sit in and block the wellbore.

The setting mechanism can be a setting push tube. The setting push tube has controllable explosive therein, which will explode according to the signal transmitted via the cable and push the push tube to move downward. The push tube matches with the push ring on the bridge plug 3 and pushes the push ring to move downward. Correspondingly, the push ring pushes the upper slip to move downward to squeeze the rubber cylinder, and the rubber cylinder is compressed and expanded and thereby blocks the wellbore. Then the upper and lower slips are pushed to stretch out and be anchored on the wellbore to complete the blocking.

In order to ensure the bridge plug 3 to be successfully set at the predetermined location, in step S10, when lowering the bridge plug 3, pressure is applied from outside the well to the wellbore 1 to push the bridge plug 3 to move until the bridge plug 3 reaches the predetermined location. After the pressure application from outside the well to the wellbore 1 has been stopped, the setting mechanism is controlled by the cable to push the bridge plug 3 to block the wellbore. The depth position of the predetermined location is higher than the top end of the fracturing perforation section. In a specific embodiment, the depth position of the predetermined location is 10 m-20 m (about 15 meters) higher than the top end of the fracturing perforation section.

In view that the cable cannot apply a downward pushing force to the bridge plug 3, in this embodiment, the outer diameter of the bridge plug 3 matches with the inner diameter of the wellbore 1 such that the bridge plug 3 can be located in the wellbore 1 in the under-pressure condition. Since the bridge plug 3 can be pushed to move downward until it reaches the predetermined location by pressure applied from outside the well, when the bridge plug 3 reaches the predetermined location to perform the blocking, for the avoidance of a situation where the cable cannot bear the downward impact tension when the setting mechanism pushes the bridge plug 3 by explosion, the pressure applied from outside the well will be relieved at this point, and the (upward) stratum pressure under the bridge plug 3 can cooperate with the (downward) pushing force provided by the setting mechanism above the bridge plug 3 to set the bridge plug 3 at the predetermined location to ensure successful blocking.

In step S20, water is injected into the wellbore 1 to replace the gases therein after the pressure in the wellbore 1 has been relieved to be balanced with the atmospheric pressure. In this embodiment, the natural gas in the wellbore 1 (above the bridge plug 3) can be discharged by a wellhead pressure relieving device to a specified location for recycling. Meanwhile, since the wellbore 1 is evacuated, a well-killing-free condition is formed.

In step S30 of this embodiment, for casings 1 of different outer diameters, oil pipes 2 of different outer diameters that match with the casings are lowered. To be specific, if the casing 1 has an outer diameter of 177.80 mm, the outer diameter of the matched production oil pipe 2 is 88.9 mm, 73.0 mm or 60.3 mm; if the casing 1 has an outer diameter of 139.70, the outer diameter of the matched production oil pipe 2 is 73.0 mm or 60.3 mm; if the casing 1 has an outer diameter of 114.30 mm, the outer diameter of the matched production oil pipe 1 is 60.3 mm.

The bridge plug used in the method of lowering an oil pipe in a gas well without well-killing in this embodiment may be a soluble bridge plug, and of course, may also be a drillable bridge plug. When a drillable bridge plug is used, a milling tool can be lowered through the oil pipe to drill the bridge plug after the oil pipe has been lowered to the location of the bridge plug, so as to realize the deblocking. In order to avoid drillings, a soluble bridge plug is preferred to be used. In order to facilitate the dissolution so as to increase the deblocking success rate, the soluble bridge plug is made of an Mg—Al—Zn—Sn alloy. To be specific, reference can be made to the soluble bridge plugs provided in the above embodiments, and no redundant description will be given in this embodiment.

The method of lowering an oil pipe in a gas well without well-killing in this embodiment further comprises the step of: injecting a bridge plug dissolving solution through the oil pipe to dissolve the soluble bridge plug after the oil pipe has been lowered to the location of the bridge plug.

In this step, the bridge plug dissolving solution may be formed by one or a mixture of several of an acidic salt buffer solution, a glutamic acid-hydrochloric acid buffer solution, an acetic acid-sodium acetate buffer solution and a citric acid-sodium citrate buffer solution. The acidic salt buffer solution may be a sodium bicarbonate solution, a potassium bicarbonate solution or a sodium bisulfite solution. The addition amount of acidic salt is 0.05-0.4 mol/L. Further, in order to control the speed of dissolution of the bridge plug, a corrosion inhibitor may also be added in the bridge plug dissolving solution. Besides, the dissolution temperature may be no less than 45° C.

In this embodiment, the respective addition amount of glutamic acid-hydrochloric acid, acetic acid-sodium acetate and citric acid-sodium citrate is 0.1-0.3 mol/L. In one embodiment, a solution of 0.05-0.4 mol/L of sodium bicarbonate is taken as the bridge plug dissolving solution, and the mass loss of the bridge plug 3 is more than 40% within 30 min. In one embodiment, a solution of 0.1-0.3 mol/L of glutamic acid-hydrochloric acid is taken as the bridge plug dissolving solution, and the mass loss of the bridge plug 3 is more than 50% within 30 min. In one embodiment, a solution of 0.1-0.3 mol/L of acetic acid-sodium acetate is taken as the bridge plug dissolving solution, and the mass loss of the bridge plug 3 is more than 55% within 30 min. In one embodiment, a solution of 0.1-0.3 mol/L of citric acid-sodium citrate is taken as the bridge plug dissolving solution, and the mass loss of the bridge plug 3 is more than 50% within 30 min.

According to field tests, as compared to the conventional methods of lowering an oil pipe, the method of lowering an oil pipe in this embodiment saves 25-50% of the cost per well, reduces the period by 33%, and also reduces the damage to the reservoir, and thus is beneficial to improving the recovery ratio. When the workload is expected to be 400 wells, 150 thousand Yuan will be saved for each well, and 60 million Yuan is expected to be saved in total.

Meanwhile, the soluble bridge plug 3 provided in this embodiment not only has the high strength and soluble properties, but also has the characteristics of low production cost, simple manufacturing process and easy scale application, and thus has a broad prospect of application in the field of oil field development. It also solves the conventional problems that the soluble bridge plug 3 can be dissolved in water and has poor controllability.

Besides, when the controllable dissolution bridge plug 3 is used in the process of lowering the oil pipe 2, the production oil pipe 2 of a selected specification is lowered without pressure to the location of the controllable dissolution bridge plug 3, and a bridge plug dissolving solution is injected into the production oil pipe 2 to dissolve the controllable dissolution bridge plug 3 to realize the deblocking. Thus, the purpose of lowering the production oil pipe 2 without pressure in the well-killing-free condition after fracturing is achieved, which greatly reduces the manufacturing cost, period and risks regarding the operations in the wellbore 1 after fracturing. In addition, the problems that the kill fluid will greatly damage the reservoir and the operation period is long in a case where the conventional methods for lowering the oil pipe 2 are adopted are avoided, in which conventional methods well-killing using the kill fluid and pressure tests are carried out prior to lowering the production oil pipe 2 of a desired specification in the pressure-free condition.

Any numerical value cited in this text includes all values including the lower and the upper values, in increments of one unit, between the lower limiting value and the upper limiting value, provided that there is a separation of at least two units between any lower value and any higher value. For example, if it is elaborated that the value of the number of a component or of a process variable (such as temperature, pressure, time, etc.) is from 1 to 90, preferably from 20-80, and more preferably from 30-70, then the purpose is to illustrate that the Description also explicitly lists the values such as from 15-85, from 22 to 68, from 43 to 51 and from 30-32. As for values smaller than 1, it shall be appreciated appropriately that one unit is 0.0001, 0.001, 0.01 or 0.1. These are only examples for explicit expression, and it can be regarded that all possible combinations of values listed between the minimum value and the maximum value have been explicitly elaborated in a similar way in the Description.

Unless otherwise stated, all ranges include the endpoints and all numbers that fall between the endpoints. The use of "about" or "approximately" together with a range applies to both ends of the range. Therefore, the expression "about 20 to 30" is intended to cover "about 20 to about 30", and at least includes the expressly pointed out endpoints.

The disclosures of all articles and references, including patent applications and publications, are incorporated therein by reference for all purposes. The term "substantially consists of . . . " which describes a combination should include the determined elements, components, parts or steps, as well as other elements, components, parts or steps that in substance do not affect the basic novel features of the combination. The use of terms "contain" or "comprise" to describe the combination of the elements, components, parts or steps therein also take into account the embodiment substantially constructed by these elements, components, parts or steps. Here, by using the term "can", it is intended to explain that any described attribute that "can" be included is selectable.

Multiple elements, components, parts or steps can be provided by a single integral element, component, part or step. Alternatively, a single integral element, component, part or step can be divided into a plurality of separated elements, components, parts or steps. The terms "a" or "one" used to describe the elements, components, parts or steps are not intended to exclude other elements, components, parts or steps.

It should be understood that the above description is for graphic illustration rather than limitation. By reading the above description, many embodiments and applications other than the provided examples would be obvious for persons skilled in the art. Therefore, the scope of the teaching should be determined not with reference to the above description, but should instead be determined with reference to the appended claims, along with the full scope of equivalents possessed by the claims. The disclosures of all articles and references, including patent applications and publications, are incorporated herein by reference for purpose of being comprehensive. The omission in the foregoing claims of any aspect of the subject matter that is disclosed herein is not a disclaimer of such subject matter, nor should it be regarded that the inventor did not consider such subject matter to be part of the disclosed inventive subject matter.

The invention claimed is:

1. A method of lowering an oil pipe in a gas well without well-killing, wherein the method comprises the steps of:

lowering a bridge plug in a wellbore such that the bridge plug blocks the wellbore at a predetermined location in the wellbore, wherein the bridge plug is a soluble bridge plug and the soluble bridge plug is made of an Mg—Al—Zn—Sn alloy material;

injecting water in the wellbore after pressure in the wellbore has been relieved so as to replace gases in the wellbore; and lowering an oil pipe in the wellbore to the location of the bridge plug.

2. The method of lowering an oil pipe in a gas well without well-killing according to claim 1, wherein the bridge plug is lowered to the predetermined location in the wellbore in an under-pressure condition by means of a cable, a setting mechanism connected to the cable is connected above the bridge plug, and the setting mechanism is controlled by the cable to push the bridge plug to block the wellbore.

3. The method of lowering an oil pipe in a gas well without well-killing according to claim 2, wherein, when lowering the bridge plug, pressure is applied from outside the well into the wellbore to push the bridge plug to move until the bridge plug reaches the predetermined location, and the setting mechanism is controlled by the cable to push the bridge plug to block the wellbore after the pressure application from outside the well to the wellbore has been stopped.

4. The method of lowering an oil pipe in a gas well without well-killing according to claim 1, wherein, water is injected into the wellbore to replace gases therein after pressure in the wellbore has been relieved to be balanced with atmospheric pressure.

5. The method of lowering an oil pipe in a gas well without well-killing according to claim 1, wherein a depth position of the predetermined location is higher than a top end of a fracturing perforation section.

6. The method of lowering an oil pipe in a gas well without well-killing according to claim 1, wherein the method further comprises: injecting a bridge plug dissolving solution through the oil pipe to dissolve the soluble bridge plug after the oil pipe has been lowered to the location of the bridge plug.

7. The method of lowering an oil pipe in a gas well without well-killing according to claim 6, wherein the bridge plug dissolving solution is formed by one or a mixture of several of an acidic salt buffer solution, a glutamic acid-hydrochloric acid buffer solution, an acetic acid-sodium acetate buffer solution and a citric acid-sodium citrate buffer solution.

8. The method of lowering an oil pipe in a gas well without well-killing according to claim 7, wherein the acidic salt buffer solution is a sodium bicarbonate solution, a potassium bicarbonate solution or a sodium bisulfate solution.

9. The method of lowering an oil pipe in a gas well without well-killing according to claim 8, wherein the addition amount of acidic salt is 0.05-0.4 mol/L.

10. The method of lowering an oil pipe in a gas well without well-killing according to claim 7, wherein the respective addition amount of glutamic acid-hydrochloric acid, acetic acid-sodium acetate and citric acid-sodium citrate is 0.1-0.3 mol/L.

* * * * *